US009660396B2

(12) United States Patent
Chen et al.

(10) Patent No.: US 9,660,396 B2
(45) Date of Patent: May 23, 2017

(54) CABLE CONNECTOR ASSEMBLY WITH IMPROVED INDICATION EFFECT

(71) Applicant: FOXCONN INTERCONNECT TECHNOLOGY LIMITED, Grand Cayman (KY)

(72) Inventors: Chi-Ming Chen, New Taipei (TW); De-Gang Zhang, Kunshan (CN); Zhi-Yang Li, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/952,095

(22) Filed: Nov. 25, 2015

(65) Prior Publication Data

US 2016/0149353 A1 May 26, 2016

(30) Foreign Application Priority Data

Nov. 25, 2014 (CN) ..... 2014 1 0684336

(51) Int. Cl.
*H01R 3/00* (2006.01)
*H01R 13/717* (2006.01)
(Continued)

(52) U.S. Cl.
CPC ..... *H01R 13/7175* (2013.01); *H01R 13/6675* (2013.01); *H01R 24/60* (2013.01); *H01R 31/065* (2013.01)

(58) Field of Classification Search
CPC .. H01R 31/065; H01R 24/60; H01R 13/6675; H01R 13/7175
(Continued)

(56) References Cited

U.S. PATENT DOCUMENTS 5,797,771 A * 8/1998 Garside ..... H01R 13/6275 439/358
5,920,459 A * 7/1999 Weber ..... H01R 13/6215 361/752
(Continued)

FOREIGN PATENT DOCUMENTS

CN 102647014 A 8/2012
CN 203607564 U 5/2014
(Continued)

*Primary Examiner* — Abdullah Riyami
*Assistant Examiner* — Nelson R Burgos-Guntin
(74) *Attorney, Agent, or Firm* — Wei Te Chung; Ming Chieh Chang

(57) ABSTRACT

A cable connector assembly (100) includes: a cable (30) having a number of inner wires; a first connector (10) including a main body (120), plural contacts (121) retained in the main body, a first circuit board (130), a luminous element (152), and a cover; and a second circuit board (180) assembled on a rear end of the first circuit board and getting power and grounding source from the first circuit board. The second circuit board includes a detection contact (182) electrically connected to an inner wire of the cable, and a chip (181) electrically connected respectively to the luminous element and the detection contact. The chip detects a voltage difference between the power source and the first connector. A light is emitted by the luminous element passing through the cover to indicate a charging status of the charging device.

18 Claims, 8 Drawing Sheets

(51) Int. Cl.
*H01R 13/66* (2006.01)
*H01R 24/60* (2011.01)
*H01R 31/06* (2006.01)

(58) Field of Classification Search
USPC ..... 439/490, 76.1, 620.02, 489, 488, 456, 439/459, 564
See application file for complete search history.

(56) References Cited

U.S. PATENT DOCUMENTS 6,257,906 B1 * 7/2001 Price ..... H01R 13/60 439/131
6,361,357 B1 * 3/2002 Stillwell ..... H01R 13/6691 362/23.01
6,733,333 B1 * 5/2004 Chen ..... H01R 13/6658 439/552
7,247,046 B1 * 7/2007 Wu ..... H01R 13/6691 439/490
7,393,237 B2 * 7/2008 Kuo ..... H01R 13/6691 362/249.01
7,632,134 B2 * 12/2009 Su ..... H01R 13/44 439/490
7,753,689 B1 * 7/2010 Wu ..... H01R 13/648 439/490
7,758,369 B2 * 7/2010 Miller ..... H01R 13/6275 439/352
7,758,373 B2 * 7/2010 Zhou ..... H01R 13/562 439/455
7,914,320 B2 * 3/2011 Ko ..... H01R 13/502 439/490
8,105,106 B1 * 1/2012 Stoddard ..... H01R 13/717 362/95
8,251,740 B2 * 8/2012 Grice ..... H01R 13/641 439/490
8,333,608 B2 * 12/2012 Ko ..... H01R 13/641 439/490
8,382,510 B2 * 2/2013 Lee ..... H01R 12/724 439/490
8,517,751 B1 * 8/2013 Golko ..... H01R 13/516 439/218
8,540,529 B2 * 9/2013 Warren ..... H01R 13/7175 362/555
8,632,351 B2 * 1/2014 Wu ..... H01R 13/6315 439/248
8,740,640 B2 * 6/2014 Hardy ..... H01R 13/7175 439/490
8,814,591 B2 * 8/2014 Pong ..... H01R 13/7172 439/490
9,011,179 B2 * 4/2015 Siahaan ..... H01R 13/504 439/606
9,022,605 B2 * 5/2015 Bushnell ..... H01R 13/631 320/107
D734,272 S * 7/2015 Dang ..... D13/153
2003/0194906 A1 10/2003 Arkin et al.
2008/0003867 A1 * 1/2008 Wu ..... H01R 13/6658 439/490
2012/0214326 A1 * 8/2012 Ko ..... G02B 6/3817 439/345

FOREIGN PATENT DOCUMENTS

TW M405069 U1 6/2011
TW M424655 U 3/2012
TW 201234184 A 6/2012
TW 201234189 A 8/2012
TW M491982 U 12/2014

* cited by examiner

CABLE CONNECTOR ASSEMBLY WITH IMPROVED INDICATION EFFECT

BACKGROUND OF THE INVENTION

1. Field of the Invention

The present invention relates to a cable connector assembly, and more particularly to a cable connector assembly having a luminous element to indicate charging status of a charging apparatus.

2. Description of Related Art

A cable connector assembly is usually used to charge a rechargeable battery of a mobile electronic device. Cable connector assemblies usually do not have an indicator to indicate the charging status of a charging apparatus. Therefore, users need to turn on the apparatus for viewing the charging status, which is inconvenient.

China Publication No. 102647014 discloses a cable structure with an indicating function, which is composed of a cable, a first connector plug, and an indication unit, wherein: the first connector plug is provided with a main body part and a connection part and is coupled with one end of the cable; the indication unit is fixedly arranged in the main body part and is provided with at least one indicator which is coupled to a circuit board and has an indicating function at the main body part; the circuit board is connected to a power circuit between the cable and the first connector plug in a line mode; and, according to the comparison of the detection circuit of the circuit board, the indicators respectively indicate the display of 'Charging' and 'Charge Complete.' Therefore, a user can directly observe the charging condition of the hand-held device through the display of the indication unit without awaking the screen of the hand-held device.

However, the indication unit of the above solution is fixedly arranged in the main body part. The indication unit increases the overall height of the connector.

A cable connector assembly with an improved indication effect is desired.

BRIEF SUMMARY OF THE INVENTION

Accordingly, an object of the present invention is to provide a cable connector assembly having improved indication effect.

In order to achieve the above-mentioned object, a cable connector assembly comprising: a cable having a number of inner wires, one end of the cable adapted to connect to a power source for receiving a power signal and a grounding signal; a first connector including a main body, a plurality of contacts retained in the main body, a first circuit board assembled on a rear end of the main body and electrically connected with the contacts and the cable, a luminous element, and a cover enclosing the main body and the first circuit board; and a second circuit board assembled on a rear end of the first circuit board and getting power and grounding source from the first circuit board, the second circuit board comprising a chip and a detection contact, the detection contact electrically connected to an inner wire of the cable, the chip electrically connected respectively to the luminous element and the detection contact, the chip detecting a voltage difference between the power source and the first connector when mating with a charging device and changing a lighting mode of the translucent component according to the voltage difference, a light emitted by the luminous element passing through the cover to indicate a charging status of the charging device.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
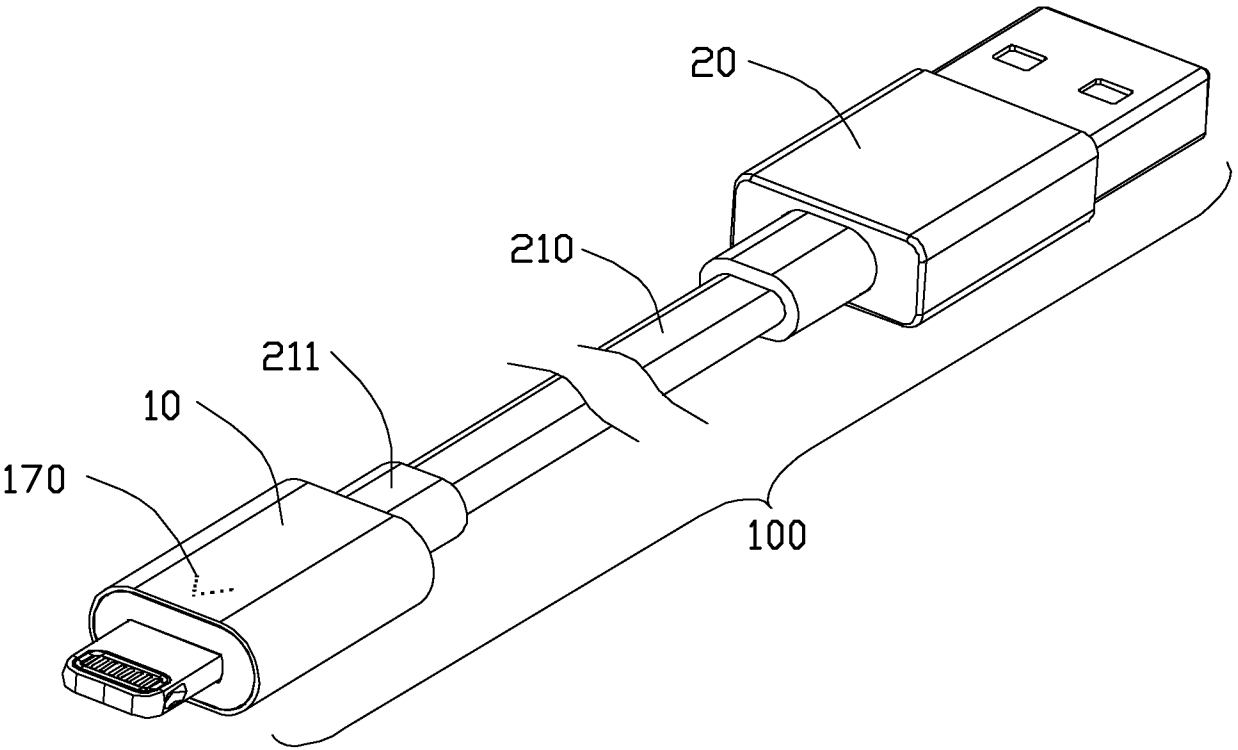
FIG. 1 is a perspective view of a cable connector assembly according to the present invention.

Referring to FIG. 1, a cable connector assembly 100 in accordance with the present invention comprises a first connector 10 for connecting with a mobile phone and other mobile electronic devices, a second connector 20 connecting to a power source and a cable 210 electrically connected between the first connector 10 and the second connector 20. In present embodiment, the first connector is a lightning connector; the second connector is a USB connector. In other embodiments, the first connector 10 can be other types of connectors.

Figure 2:
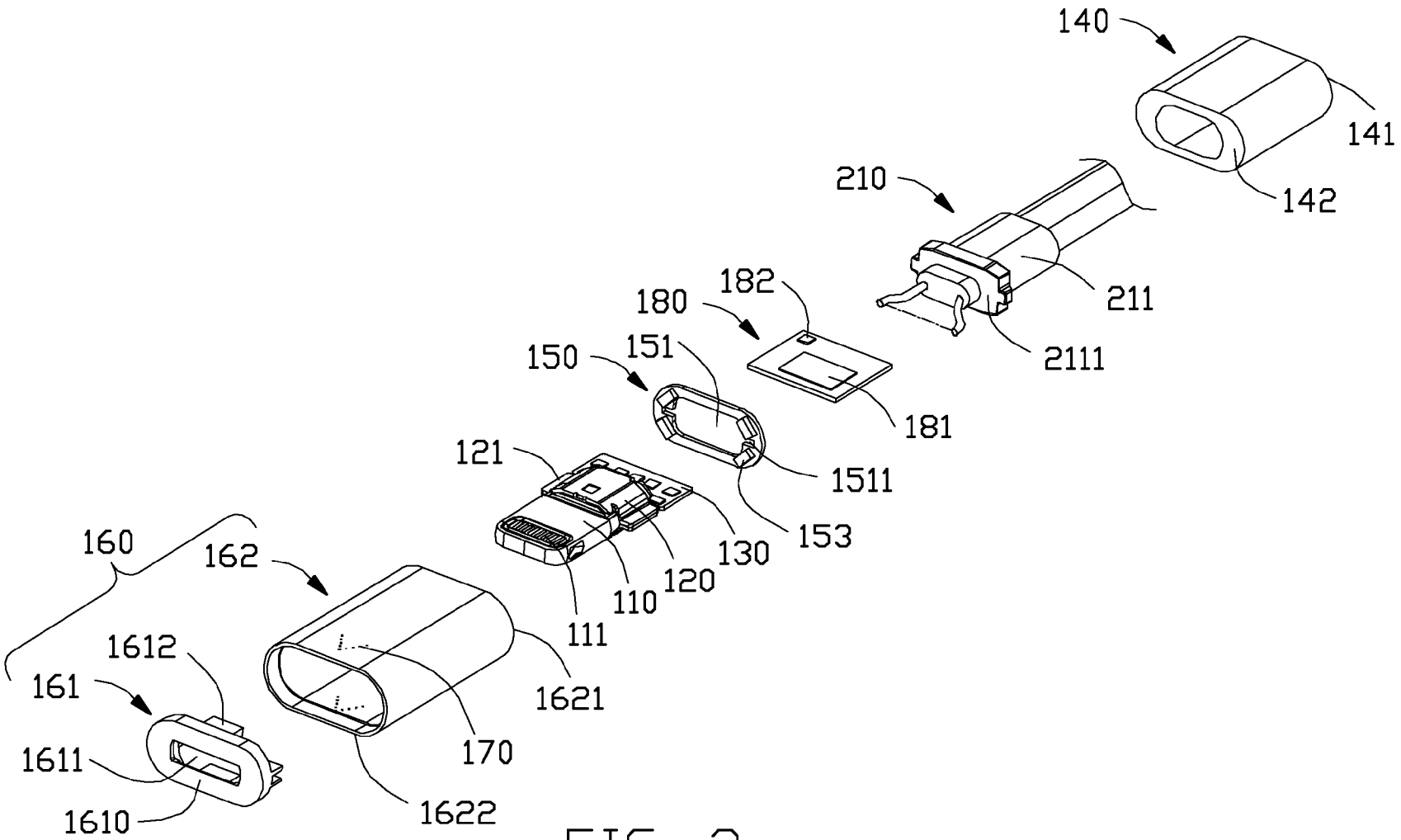
FIGS. 2-4 are partially exploded views of the cable connector assembly shown in FIG. 1.

Referring to FIG. 2, the first connector includes a main body 110, a number of contacts 111 retained in the main body 110 and exposed on two opposite sides of a front end of the main body 110 to commonly form a mating member, a first/horizontal circuit board 130 assembled on a rear end of the main body 110 and electrically connected to the contacts 111, a metal shell 120 enclosing the first circuit board 130, a second circuit board 180 fixed parallel to the first circuit board 130, a third vertical circuit board 150, an inner mold 140 and a cover 160.

The metal shell 120 defines a fixing plate 121 extending along a horizontal direction on each of the opposite sides of the metal shell 120.

The second circuit board 180 has a chip 181 and defines a detection contact 182.

The third circuit board 150 is generally annular and defines a through hole 151. A pair of notches 1511 is defined on the opposite sides of the inner edge of the third circuit board 150. A Luminous elements 152 and 153 are installed on a front side of the third circuit board 150. The luminous element 152 or 153 is electrically connected to a power source of the first circuit board 130 via a pair of wires or conductors including a power wire and a grounding wire, through which the luminous element 152 or 153 is powered by the first circuit board powered. The luminous element 152 or 153 is a light emitting diode, a semiconductor laser or other electronic components which can emit light.

The inner mold 140 defines a first end 141 and a opposite second end 142.

The cover 160 includes a front plate portion 161 and a tubular portion 162. The front plate portion 161 defines a through hole 1611 therethrough. A plurality of positioning portions 1612 are formed on the rear side wall of the front plate portion 161 around the through hole 1611. The tubular portion 162 defines a first end 1621 having a smaller opening and a second end 1622 having a bigger opening. A translucent portion 170 is defined on a top side of a front end of the tubular portion 162. The translucent portion 170 is a number of though holes distributing in a certain mark shape. The distribution of the through holes can be a product logo or other shapes playing a iconic role. The translucent portion 170 can also be through slots or other structures having a light-transmitting function.

The cable 210 defines a strain relief 211. A fixing portion 2111 essentially be of a rectangular block is vertically defined on a front end of the strain relief 211.

Figure 3:
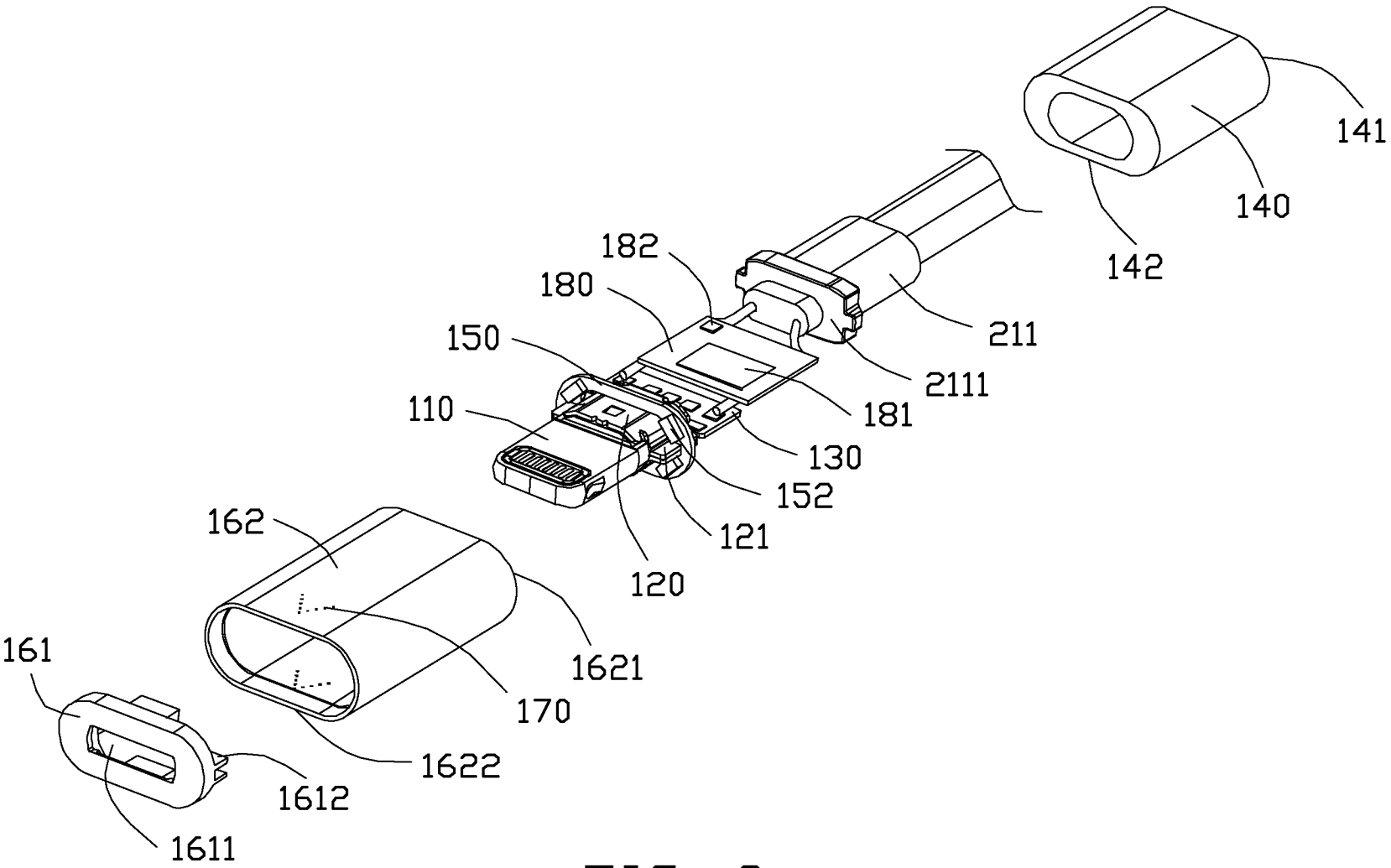
Figure 4:
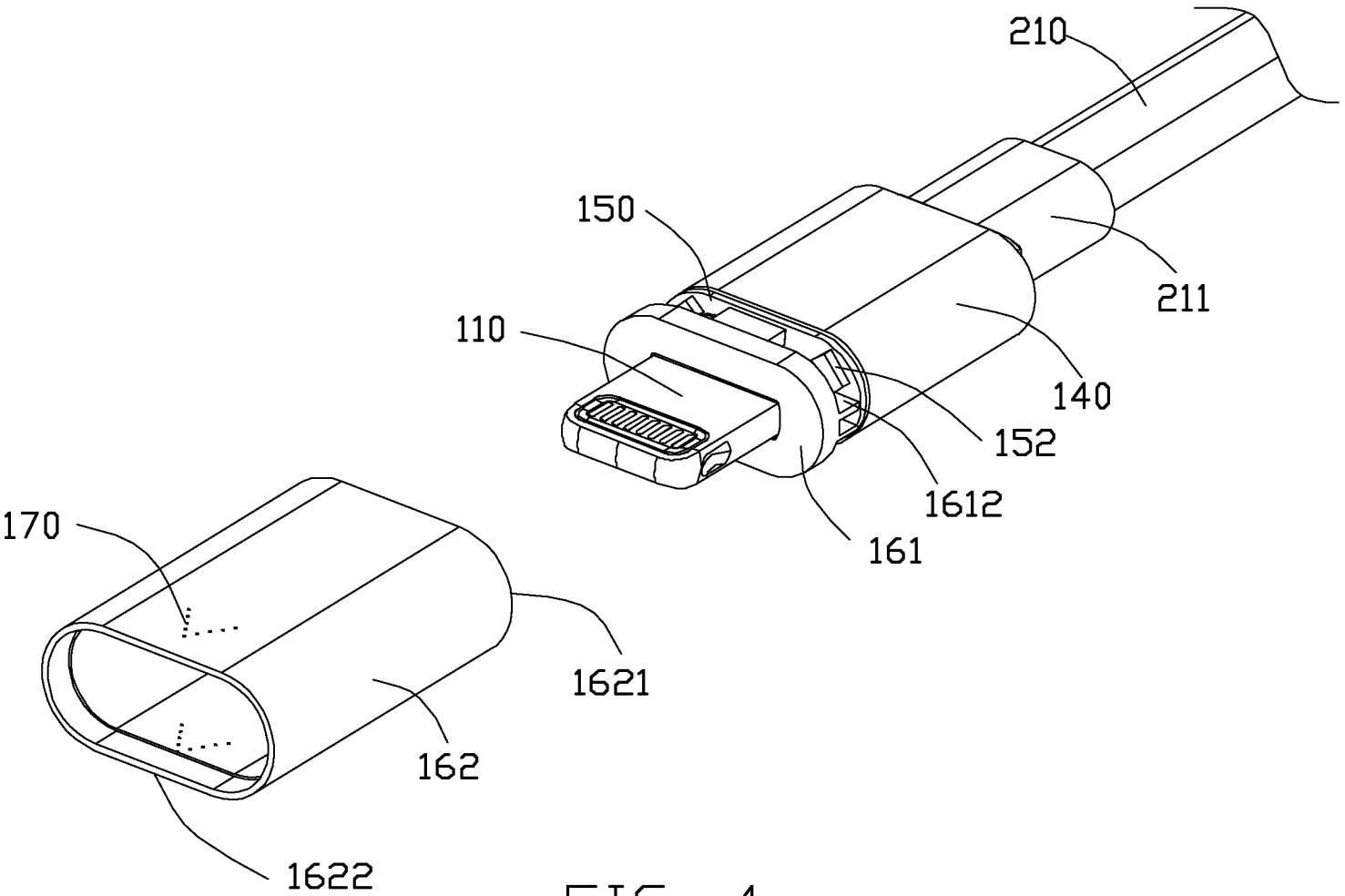
Figure 5:
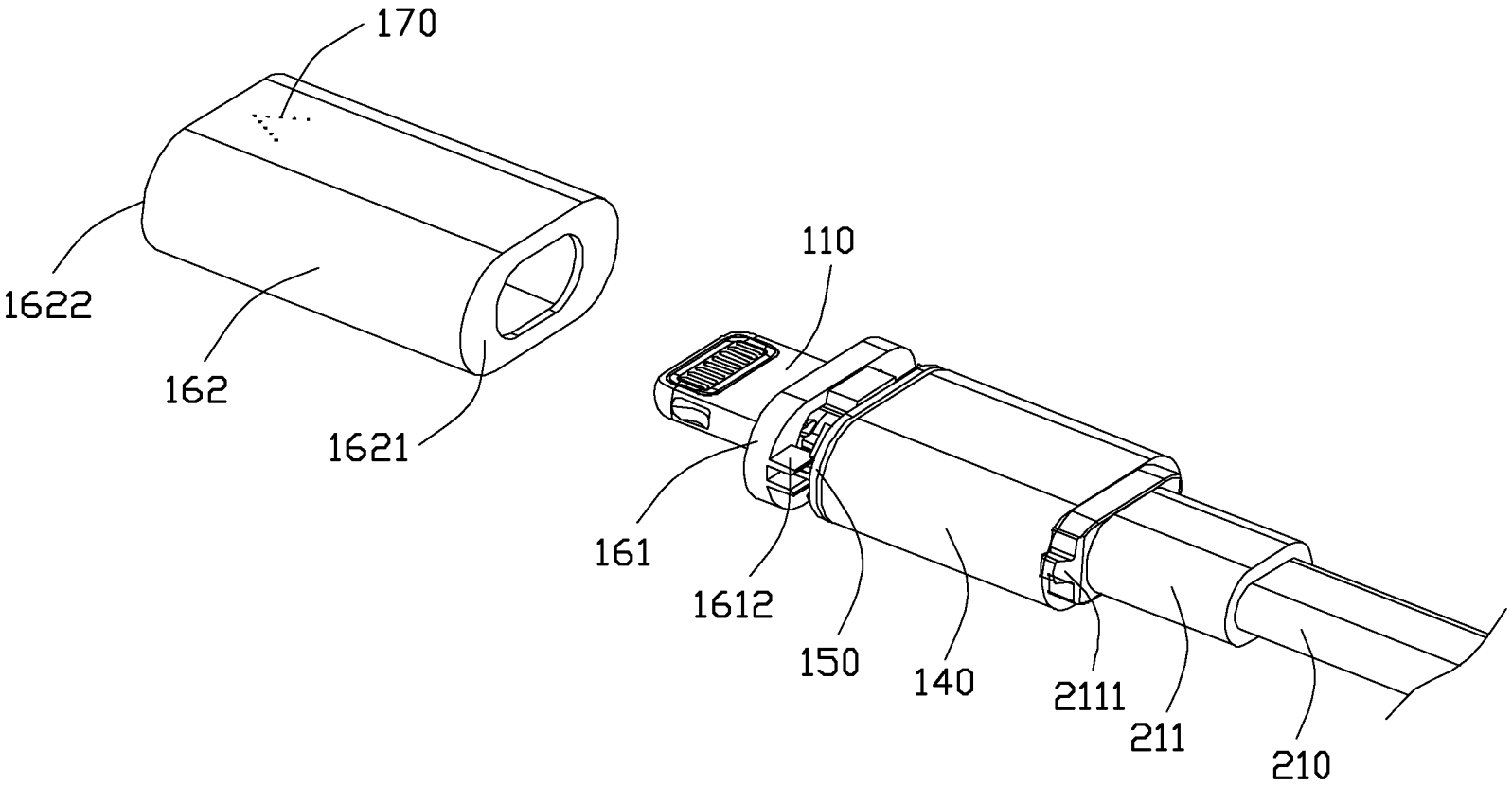
FIG. 5 is a partially exploded view similar to FIG. 4, but from a different aspect.
Figure 6:
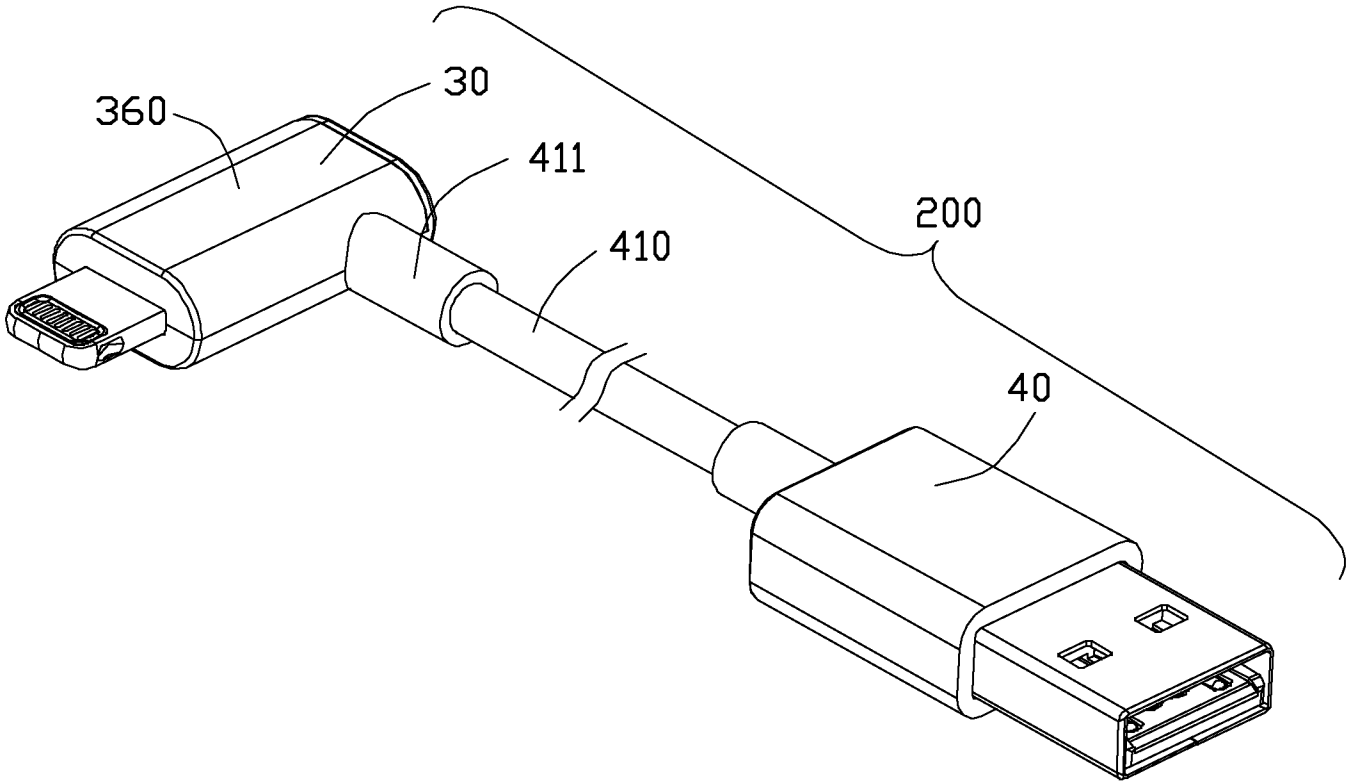
FIG. 6 is a perspective view of a cable connector assembly according to the present invention, but in a second embodiment.

Referring to FIGS. 3 and 4, when assembled, the internal wires (not labeled) of the cable 210 is soldered to the first circuit board 130. The second circuit board 180 is assembled on a rear end of the first circuit board 130 to be electrically connected with the grounding signal and the power signal from the first circuit board 130. The detection contact 182 is electrically connected to the control pin of the chip 181 on the second circuit board 180. The detection contact 182 is also electrically connected to the power single of the second connector 20 by an internal wire of the cable 210. The main body 110 is passed through the through hole 151 of the third circuit board 150, the fixing plates 121 is received in the corresponding notch 1511 of the second circuit board 150 to vertically fix the third circuit board 150 on the metal shell 120. The luminous element 152 of the third circuit board 150 is electrically connected to a control pin of the chip 181. The inner mold 140 is molded on the conjunction portion of the cable 210, the first circuit board 130 and the second circuit board 180, and the first end 141 of the inner mold 140 is against the strain relief 211. The rear side wall of the third circuit board 150 is against the second end 142 of the inner mold 140. In the present embodiment, the third circuit board 150 is fixed on the metal shell 120 by glue.

Referring to FIGS. 3 to 4, the front end of the main body 110 is further passed though the through hole 1611 of the front plate portion 161 until a rear side of the positioning portions 1612 are against the front side wall of the second circuit board 150. The rear end of the cable 30 is passed through the tubular portion 162, until the rear side of the fixing portion 311 is against the first end 1621 of the tubular portion 162 and the front plate portion 161 is received and fixed in the second end 1622 of the tubular portion 162 and the holding portion 312 is received in the opening of the first end 1621. The front plate portion 161 and the fixing portion 311 are respectively fixed on the first end 1621 and the second end 1622 by glue. The front side wall of the front plate portion 161 is in a same panel with the front face of the tubular portion 162.

In the embodiment, the third circuit board 150 is fixed on the metal shell 140 by lock. In other embodiment, the third circuit board 150 is vertically fixed by other suitable means, such as adhesion, etc. to the main body 110 or inner mold 140, in this way, the light emitted by the luminous element 152 is not blocked by the main body 110 or other inner parts of the first connector 10.

When the electronic device is charging by the cable connector assembly connecting with a power source, the voltage difference between the contacts of the first connector 10 and the contacts of the second connector 20 is changing. The detection contacts 182 detects the voltage difference, and when the voltage difference is exceeds a set maximum value of the chip 182, a control signal is emitted from a control pin of the chip to make the luminous element 152 to light according to a set mode. The light emitted by the luminous element 152 is passed through the translucent portion 170 of the tubular portion 162. Thereby, the users of the charging device can understand the state of charging without turning on the device. When the voltage difference detected by the detection contact 182 reduces to a set minimum value, a control signal is emitted by the control pin of the chip 181 to change the lighting mode of the luminous element 152 to indicate the charging device is already in a charge completion status.

In the present embodiment, the first connector 10 detects the voltage difference between the first connector 10 and the second connector 20 to control the luminous element 152 to change lighting mode thereof, and then indicates the charging status of the charging device. The luminous element 152 is set on the third circuit board 150 located in a vertical plane, the light emitted by the luminous element 152 can not be blocked by the main body 110 and other inner parts of the first connector 10.

Figure 7:
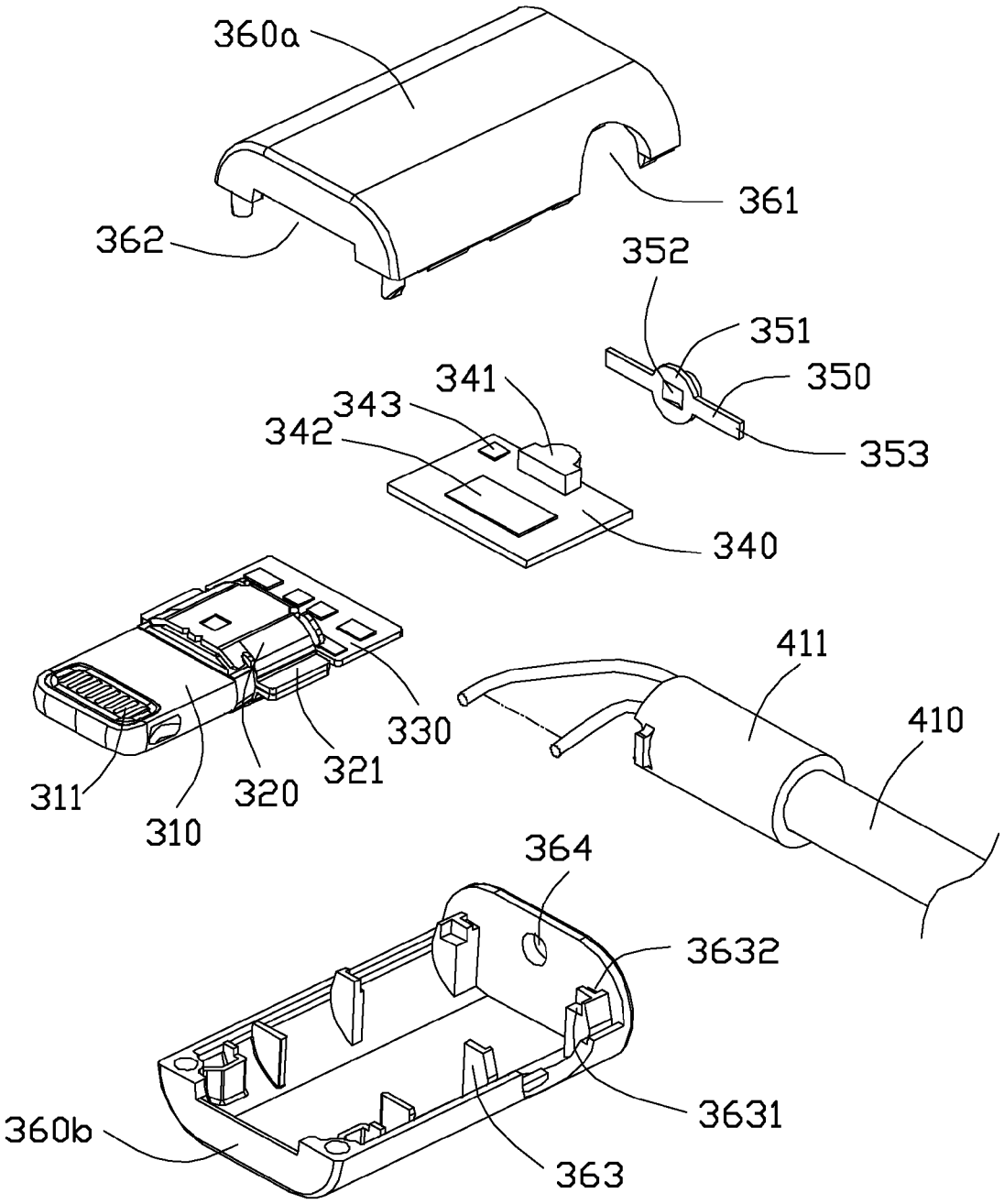
FIGS. 7-8 are partially exploded views of the cable connector assembly shown in FIG. 6.
Figure 8:
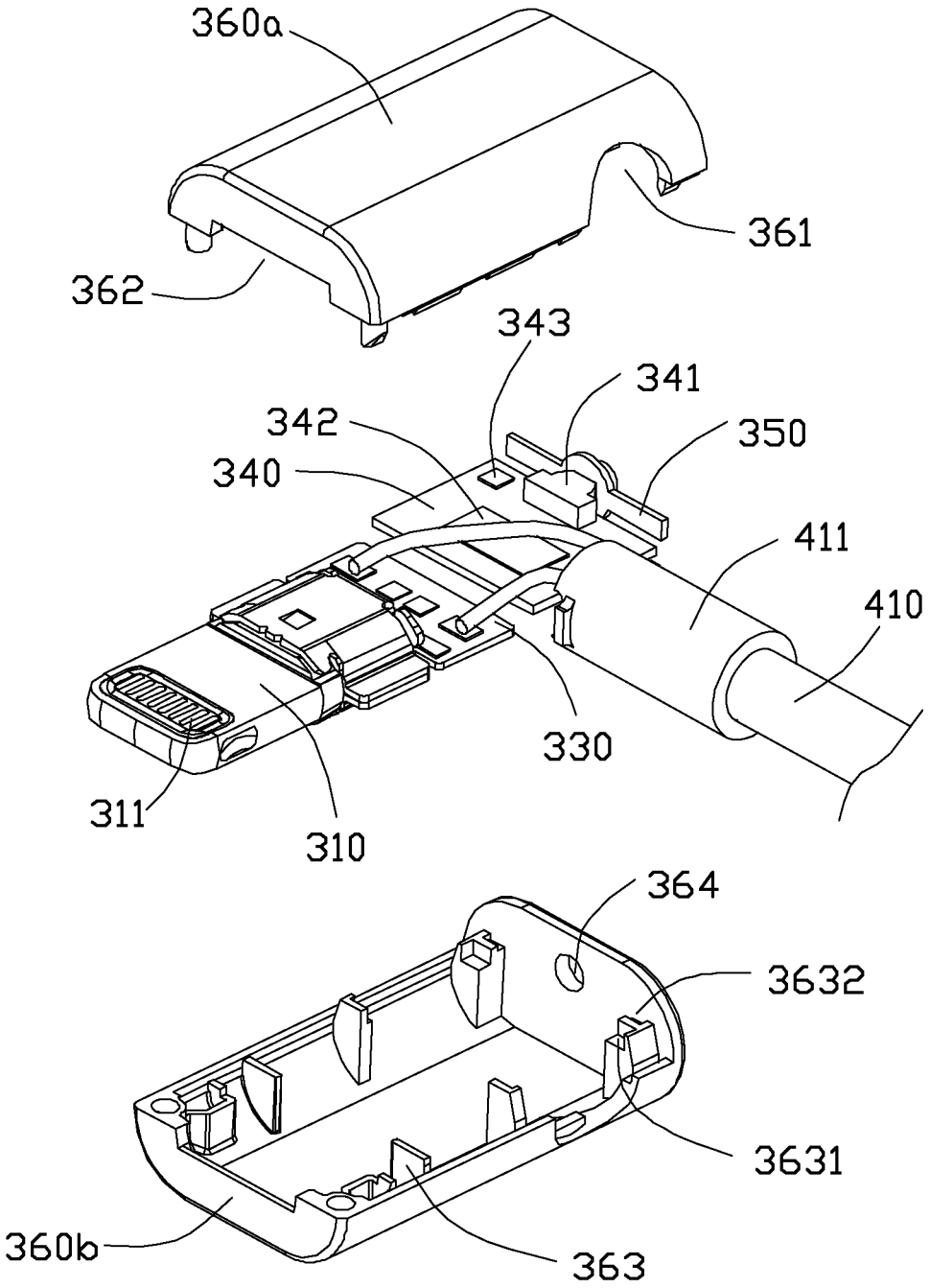

Referring to FIGS. 7 to 8, the first connector 30 includes a main body 310, a number of contacts 311 retained in the main body 310 and exposed on two opposite sides of a front end of the main body 310, a first circuit board 330 assembled on a rear end of the main body 310 and electrically connected to the contacts 311, a metal shell 320 having a pair of fixing plates 321 and enclosing the first circuit board 330, a second circuit board 340 fixed parallel to the first circuit board 330, a translucent module 350 fixed on a rear end of the second circuit board 340 and a cover 360 enclosing the main body 310, the first circuit board 330, the second circuit board 340 and the translucent module 350.

The first circuit board 330 is electrically connected with the cable 410. The second circuit board 340 is electrically connected to a power source of the first circuit board 330 via a pair of wires or conductors including a power wire and a grounding wire, through which the second circuit board 340 is powered by the first circuit board powered. A luminous element 341, a chip 342 and a detection contact 343 are soldered on the second circuit board 340. The detection contact 343 is electrically connected to a control pin of the chip 342, the detection contact 343 is also electrically connected to a power contact of the second connector 40 via an inner wire of the cable 410. The luminous element 342 is electrically connected with a control pin of the chip 342.

The translucent module 350 is perpendicularly assembled on a rear end of the second circuit board. The translucent module 350 includes a circular base portion 351, a translucent component 352 defined locating on the central of the base portion 351 and therethrough. A pair of fixing plates 353 is extended from the two opposite side of the base portion 351.

The cover 360 includes a first portion **360*a* and a second portion 360*b* engaged with the first portion 360*a* in a corresponding form, to form a receiving room having a lateral circular opening 361 and a rectangular opening 362. A number of positioning columns 363 are extended from the first portion 360*a* and the second portion 360*b* respectively, to position the main body 310, the first circuit board 330 and the second circuit board 340 therebetween. A positioning slot 3631 is defined on each of the rearward four positioning columns 363 for receiving one of four corner parts of the second circuit board 340, to fix the second circuit board 340 in the cover 360. A pair of fixing slots 3632 is defined on the two positioning columns 363 near a rear end face of the first portion 360*a* respectively, to receive the corresponding fixing plate 353, thereby the translucent module 350 is fixed in the cover 360. A circular through hole 364 is defined through a rear sidewall of the second portion 360*b*, the through hole 364 faces the translucent component 352 and make a rear end of the translucent component 352 expose threrethrough. The main body 310 and a strain relief 411 are exposed form the cover through the opening 361, 362** respectively.

When the electronic device is charging by the cable connector assembly connecting with a power source, the voltage difference between the contacts of the first connector 30 and the contacts of the second connector 40 is changing. The detection contacts 343 detects the voltage difference, and when the voltage difference is exceeds a set maximum value of the chip 342, a control signal is emitted from a control pin of the chip to make the luminous element 341 to light according to a set mode. The light emitted by the luminous element 341 is passed through the translucent component 352 of the translucent module 340 and emitted form the cover 360, thereby the users of the charging device can understand the state of charging without turning on the device. When the voltage difference detected by the detection contacts 343 reduces to a set minimum value, a control signal is emitted by the control pin of the chip 342 to change the lighting mode of the luminous element 341 to indicate the charging device is already in a charge completion status.

In the present embodiment, the cable connector assembly 200 is electrically connected between the power source and a charging device, the first connector 30 detects the voltage difference between the first connector 30 and the second connector 40 to control the luminous element 341 to change lighting mode thereof, and then indicates the charging status of the charging device. The luminous element 341 is set on a rear end of the second circuit board 340, the second circuit board 340 is fixed behind the first circuit board 330 and parallel to the first circuit board 330, thereby the light emitted by the luminous element 341 can not be blocked by the inner parts of the first connector 30 and emitted the cover 360 directly.

The luminous elements 152, 341 of the two embodiment accordance with the present invention is a light emitting diode, a semiconductor laser or other electronic components which can emit light. The switch way of the light mode of the luminous element 152, 341 according to the present invention may be a light-emitting color conversion, a light-emitting dynamic conversion or a conversion combining colors conversion and dynamic conversion.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A cable connector assembly comprising:

a cable having a number of inner wires, an end of the cable adapted to connect to a power source for receiving a power signal and a grounding signal;

a first connector including a main body, a plurality of contacts retained in the main body, a first circuit board assembled on a rear end of the main body and electrically connected with the contacts and the cable, a luminous element, and a cover enclosing the main body and the first circuit board;

a second circuit board assembled on a rear end of the first circuit board and getting power and grounding source from the first circuit board, the second circuit board comprising a chip and a detection contact, the detection contact electrically connected to an inner wire of the cable, the chip electrically connected respectively to the luminous element and the detection contact, the chip detecting a voltage difference between the power source and the first connector when mating with a charging device and changing a lighting mode of the luminous element according to the voltage difference, a light emitted by the luminous element passing through the cover to indicate a charging status of the charging device;

a metal shell enclosing a junction portion of the first circuit board and the cable; and a third circuit board fixed to the metal shell, the luminous element set on the third board.

2. The cable connector assembly as recited in claim 1, wherein the third circuit board fixed in a plane perpendicular to an insertion direction and enclosed by the cover, and wherein the luminous element is set on a front side of the third circuit board, the third circuit board being electrically connected to the first circuit board and getting power and grounding source from the first circuit board.

3. The cable connector assembly as recited in claim 2, wherein a top side of a front end of the cover defines a translucent portion, the translucent portion includes a number of holes through a top sidewall of the cover.

4. The cable connector assembly as recited in claim 3, wherein the holes are distributing in predetermined shape.

5. The cable connector assembly as recited in claim 3, wherein the cover includes a tubular portion and a front plate portion fixed on a front opening of the tubular portion, the front plate portion defines a through hole therethrough to expose a front end of the contacts, an end of the cable is passed through a rear opening of the tubular portion, and the translucent portion is positioned on the top sidewall of the tubular portion.

6. The cable connector assembly recited in claim 5, wherein a fixing plate is extended from a side of the metal shell, a through hole is defined on the third circuit board to extend the metal shell through along an insertion direction, and a notch having a side opening is extended from the through hole of the third circuit board along an outward direction, the fixing plate fixed in the notch to fix the third circuit board on the metal shell vertically.

7. The cable connector assembly recited in claim 6, further including an inner mold enclosing the first circuit board, the second circuit board, and an end of the cable, and wherein a rear sidewall of the third circuit board bears against a front end of the inner mold, and the cover encloses the inner mold.

8. The cable connector assembly recited in claim 7, wherein a plurality of positioning portions are extended from a rear side of the front plate portion along a front-to-rear direction, the positioning portion reardwardly bearing against a front sidewall of the third circuit board.

9. A cable connector assembly comprising:

a cable having a number of inner wires, an end of the cable adapted to connect to a power source for receiving a power signal and a grounding signal;

a first connector including a main body, a plurality of contacts retained in the main body, a first circuit board assembled on a rear end of the main body and electrically connected with the contacts and the cable, a luminous element, and a cover enclosing the main body and the first circuit board;

a second circuit board assembled on a rear end of the first circuit board and getting power and grounding source from the first circuit board, the second circuit board comprising a chip and a detection contact, the detection contact electrically connected to an inner wire of the cable, the chip electrically connected respectively to the luminous element and the detection contact, the chip detecting a voltage difference between the power source and the first connector when mating with a charging device and changing a lighting mode of the luminous element according to the voltage difference, a light emitted by the luminous element passing through the cover to indicate a charging status of the charging device;

wherein the luminous element is positioned on a rear end of the second circuit board to emit light through a rear sidewall of the cover.

10. The cable connector assembly recited in claim 9, wherein a translucent module is fixed behind the second circuit board and faces the luminous element, and a translucent component exposed from the rear sidewall of the cover is defined on a central portion of the translucent module.

11. The cable connector assembly recited in claim 9, wherein the cover includes a first portion and a second portion engaged with the first portion to form a receiving room to receive the main body, the first circuit board, and the second circuit board, a front opening for exposing a front end of the contacts, and a side opening for exposing the cable.

12. The cable connector assembly recited in claim 11, wherein a plurality of positioning columns are extended from the each of the first and second portions of the cover, respectively, and the positioning columns of the first portion and the positioning columns of the second portion are defined face to face.

13. The cable connector assembly recited in claim 12, wherein a positioning slot is defined on each of rearward four positioning columns of each of the first and second portions of the cover for receiving one of four corner parts of the second circuit board to fix the second circuit board in the cover.

14. The cable connector assembly recited in claim 12, wherein a pair of fixing plates are extended from two opposite sides of the translucent module and a pair of fixing slots are defined on the two positioning columns near a rear sidewall of the cover to receive the fixing plate.

15. The cable connector assembly recited in claim 14, wherein a circular through hole is defined through a rear sidewall of the cover, the through hole faces the translucent component and exposes a rear end of the translucent component.

16. A cable connector assembly comprising:

a first circuit board;

a mating member having a plurality of contacts enclosed with an insulative housing and mechanically and electrically connected to a front region of the first circuit board along a front-to-back direction;

a cable including a plurality of wires mechanically and electrically connected to a rear region of the first circuit board;

a second circuit board located behind the first circuit board and having a chip and a detecting contact thereon; and a luminous element either mounted upon a rear region of the second circuit board or a third circuit board which is located around a jointed region of the first circuit board and the mating member and is perpendicular to both said first PCB and said second PCB; wherein the first circuit board, the second circuit board and the third circuit board are discrete from one another; wherein the chip cooperates with the detecting contact to change a lighting mode of the luminous element in response to a charging device mated with the mating member.

17. The cable connector assembly as claimed in claim 16, wherein said luminous element is located upon the rear region of the second circuit board when the cable extends rearward along said front-to-back direction.

18. The cable connector assembly as claimed in claim 16, wherein said luminous element is located upon the third circuit board when the cable extends along a transverse direction perpendicular to said front-to-back direction.

* * * * *